US010017987B2

(12) United States Patent
Carvalheiro

(10) Patent No.: US 10,017,987 B2
(45) Date of Patent: Jul. 10, 2018

(54) MOTORISED DRIVE DEVICE FOR A CLOSURE OR SOLAR PROTECTION HOME-AUTOMATION FACILITY, ASSOCIATED HOME-AUTOMATION FACILITY AND METHOD FOR CONTROLLING THE OPERATION OF SUCH A DEVICE

(71) Applicant: SIMU, Gray (FR)

(72) Inventor: Emmanuel Carvalheiro, Arc les Gray (FR)

(73) Assignee: SIMU, Gray (FR)

( * ) Notice: Subject to any disclaimer, the term of this patent is extended or adjusted under 35 U.S.C. 154(b) by 0 days.

(21) Appl. No.: 15/565,919

(22) PCT Filed: Apr. 14, 2016

(86) PCT No.: PCT/EP2016/058213

§ 371 (c)(1),
(2) Date: Oct. 12, 2017

(87) PCT Pub. No.: WO2016/166206

PCT Pub. Date: Oct. 20, 2016

(65) Prior Publication Data

US 2018/0106104 A1 Apr. 19, 2018

(30) Foreign Application Priority Data

Apr. 15, 2015 (FR) ..... 15 53317

(51) Int. Cl.
*E05F 15/603* (2015.01)
*E06B 9/24* (2006.01)
(Continued)

(52) U.S. Cl.
CPC ..... *E06B 9/72* (2013.01); *E06B 2009/6809* (2013.01); *G08C 17/02* (2013.01)

(58) Field of Classification Search
CPC .... E06B 9/24; E06B 9/68; E05F 15/00; E05F 15/603
See application file for complete search history.

(56) References Cited

U.S. PATENT DOCUMENTS 5,760,558 A * 6/1998 Popat ..... E06B 9/32 160/168.1 R
5,793,174 A * 8/1998 Kovach ..... E06B 9/262 318/16

(Continued)

FOREIGN PATENT DOCUMENTS

| | | |
|---|---|---|
| EP | 1 710 389 A1 | 10/2006 |
| FR | 2 910 523 A1 | 6/2008 |
| WO | 2011/138556 A2 | 11/2011 |

OTHER PUBLICATIONS

International Search Report, dated Jun. 24, 2016, from corresponding PCT/EP2016/058213 application.

*Primary Examiner* — Bentsu Ro
(74) *Attorney, Agent, or Firm* — Young & Thompson

(57) ABSTRACT

Disclosed is a motorized drive device for a closure or solar protection home-automation facility which includes an electromechanical actuator, an electronic control unit and a standalone electric power supply device. The electronic control unit is configured to detect electric power supply and supply interruption periods of the electromechanical actuator from at least one photovoltaic cell, using only a unit for measuring a magnitude linked to the electric power supply of the electromechanical actuator by the at least one photovoltaic cell, and resetting at least one portion of the data stored by the electronic control unit, following the simulation of a sequence of electric power supply and supply interruption periods of the electromechanical actuator, wherein the electric power supply and supply interruption periods are detected via measurement elements.

11 Claims, 3 Drawing Sheets

(51) Int. Cl.

| | |
|---|---|
| ***E06B 9/68*** | (2006.01) |
| ***E06B 9/72*** | (2006.01) |
| *G08C 17/02* | (2006.01) |

(56) References Cited

U.S. PATENT DOCUMENTS

| | | | | |
|---|---|---|---|---|
| 7,129,662 | B2 * | 10/2006 | D'ayot | E06B 9/68 318/468 |
| 8,165,719 | B2 * | 4/2012 | Kinney | E06B 7/08 318/266 |
| 8,723,466 | B2 * | 5/2014 | Chambers | E05F 15/79 160/166.1 |
| 2008/0150461 | A1 | 6/2008 | Adamus et al. | |

* cited by examiner

MOTORISED DRIVE DEVICE FOR A CLOSURE OR SOLAR PROTECTION HOME-AUTOMATION FACILITY, ASSOCIATED HOME-AUTOMATION FACILITY AND METHOD FOR CONTROLLING THE OPERATION OF SUCH A DEVICE

The present invention relates to a motorized drive device for a closure or solar protection home-automation facility.

The present invention also relates to a closure or solar protection home-automation facility comprising a windable screen, using such a motorized drive device, able to be wound on a tube rotated by an electromechanical actuator, as well as a method for controlling the operation of such a motorized drive device.

In general, the present invention relates to the field of concealment devices comprising a motorized drive device setting a screen in motion between at least one first position and one second position.

A motorized drive device comprises an electromechanical actuator for a movable element for closing, concealing or providing solar protection such as a shutter, door, gate, blind, or any other equivalent material, hereinafter referred to as a screen.

Document FR 2,910,523 A1 is already known, and describes a motorized drive device for a closure or solar protection home-automation facility comprising an electromechanical actuator, an electronic control unit and an autonomous power supply device. The autonomous power supply device comprises a battery and a photovoltaic cell. The electromechanical actuator is electrically connected to the autonomous power supply device. The electronic control unit comprises a wireless command order receiving module.

The electronic control unit is configured to detect information sent via a power supply line connecting the photovoltaic cell to the electromechanical actuator using a switch positioned on the power supply line, as well as using elements for detecting variations of the voltage on the power supply line.

However, this motorized drive device has the drawback of adding a switch positioned on the power supply line connecting the photovoltaic cell to the electromechanical actuator to inhibit the operation of the wireless command order receiving module, so as to limit the electricity consumption by the electronic control device and prevent the discharge of the battery, between the assembly moment of the motorized drive device in the plant and the commissioning moment of the motorized drive device in the closure or solar protection home-automation facility.

Thus, the addition of this switch creates an excess cost on the motorized drive device.

Furthermore, the use of such a switch requires being able to access the latter, following the assembly of the motorized drive device, in particular in a box of the closure or solar protection home-automation facility.

The present invention aims to resolve the aforementioned drawbacks and proposes a motorized drive device for a closure or solar protection home-automation facility, a closure or solar protection home-automation facility associated, as well as a method for controlling the operation of such a device making it possible to reduce the electricity consumption by an electronic control unit and avoid the discharge of at least one battery, between the assembly moment of the motorized drive device in the plant and the commissioning moment of the motorized drive device in the closure or solar protection home-automation facility, as well as during the use of the commissioned motorized drive device in the closure or solar protection home-automation facility.

In this respect, according to a first aspect, the present invention relates to a motorized drive device for a closure or solar protection home-automation facility comprising:

- an electromechanical actuator,
- an electronic control unit,
- an autonomous power supply device, the autonomous power supply device comprising at least one battery and at least one photovoltaic cell,
  - where the electromechanical actuator is electrically connected to the autonomous power supply device.

According to the invention, the electronic control unit is configured to:

- detect power supply and cutoff periods of the electricity supply of the electromechanical actuator from the said at least one photovoltaic cell, only using elements for measuring a quantity related to the electricity supply of the electromechanical actuator by the said at least one photovoltaic cell, and
- resetting at least part of the data stored by the electronic control unit, after the simulation of a sequence of power supply and cutoff periods of the electricity supply of the electromechanical actuator, where the power supply and cutoff periods of the electricity supply are detected through measuring elements.

Thus, the elements for measuring a quantity related to the electricity supply of the electromechanical actuator by the said at least one photovoltaic cell make it possible to detect power supply and cutoff periods of the electricity supply of the electromechanical actuator from the said at least one photovoltaic cell, so as to use the said at least one photovoltaic cell, and in particular the electricity supply delivered by the latter to the electromechanical actuator, to wake up the electronic control unit or to place the electronic control unit in a standby mode.

In this way, when the elements for measuring a quantity related to the electricity supply of the electromechanical actuator by the said at least one photovoltaic cell detect the cutoff of the electricity supply of the electromechanical actuator from the said at least one photovoltaic cell, the inputs and outputs of the electronic control unit, in particular of a microcontroller, are examined at a predetermined frequency lower than that used when the measuring elements detect the electricity supply of the electromechanical actuator from the said at least one photovoltaic cell, or even not examined, so as to reduce the electricity consumption by the electronic control device and avoid the discharge of the said at least one battery.

When the elements for measuring a quantity related to the electricity supply of the electromechanical actuator by the said at least one photovoltaic cell detect the cutoff of the electricity supply of the electromechanical actuator from the said at least one photovoltaic cell, the electronic control unit enters a standby mode, so as to reduce the electricity consumption by the electronic control device and avoid the discharge of the said at least one battery.

When the elements for measuring a quantity related to the electricity supply of the electromechanical actuator by the said at least one photovoltaic cell detect the electricity supply of the electromechanical actuator from the said at least one photovoltaic cell, the motorized drive device is able to be controlled.

Furthermore, the electronic control unit can be reset, at least partially, by executing a series of electricity supply and cutoff periods of the electromechanical actuator, where the electricity supply and cutoff periods of the electrochemical actuator are determined through measuring elements measuring a quantity related to the electricity supply of the electromechanical actuator by the said at least one photovoltaic cell.

In this way, at least part of the data stored by the electronic control unit is reset, following the detection by the measuring elements of the sequence of periods respectively corresponding to the presence or absence of the electrical connection connecting the said at least one photovoltaic cell to the electromechanical actuator.

Advantageously, the electronic control unit comprises a wireless command order receiving module.

According to a second aspect, the present invention relates to a closure or solar protection home-automation facility comprising a screen that is windable using a motorized drive device according to the invention on a winding tube rotated by an electromechanical actuator.

This home-automation facility has features and advantages similar to those previously described relative to the motorized drive device according to the invention.

Lastly, according to a third aspect, the present invention relates to an operating method for controlling a motorized drive device for a closure or solar protection home-automation facility, the motorized drive device comprising:

an electromechanical actuator, an electronic control unit, an autonomous power supply device, the autonomous power supply device comprising at least one battery and at least one photovoltaic cell, where the electromechanical actuator is electrically connected to the autonomous power supply device.

According to the invention, said method comprises at least the following steps:

detecting power supply and cutoff periods of the electricity supply of the electromechanical actuator from the said at least one photovoltaic cell, only using elements for measuring a quantity related to the electricity supply of the electromechanical actuator by the said at least one photovoltaic cell, simulating a sequence of supply and cutoff periods of the electricity supply of the electromechanical actuator, where the supply and cutoff periods of the electricity supply are detected through measuring elements, and resetting at least part of the data stored by the electronic control unit, after the simulation step is carried out.

This control method has features and advantages similar to those previously described relative to the motorized drive device according to the invention.

In a first embodiment, the sequence of supply and cutoff periods of the electricity supply of the electromechanical actuator is simulated by the connection and disconnection of a first electrical connector connected to the said at least one photovoltaic cell cooperating with an electric connector connected to the electronic control unit.

In a second embodiment, the sequence of electricity supply and cutoff periods of the electromechanical actuator is simulated using an outside electricity supply source, where the outside electricity supply source is electrically connected to the electromechanical actuator by replacing the said at least one photovoltaic cell.

In a third embodiment, the sequence of power supply and cutoff periods of the electricity supply of the electromechanical actuator is simulated by removing a cover element from the said at least one photovoltaic cell and positioning the cover element on the said at least one photovoltaic cell.

In practice, when the electronic control unit comprises a wireless command order receiving module, this module is inhibited, following the detection by the electronic control unit of the electricity cutoff of the electromechanical actuator from the said at least one photovoltaic cell.

According to one preferred feature of the invention, the wireless command order receiving module is woken up at a predetermined frequency, so as to detect command orders sent to the electronic control unit.

Advantageously, the predetermined frequency for waking up the wireless command order receiving module depends on the illumination power determined by measuring elements measuring a quantity related to the electricity supply of the electromechanical actuator by the said at least one photovoltaic cell.

Advantageously, the predetermined frequency for waking up the wireless command order receiving module depends on the charge level of the said at least one battery.

Other particularities and advantages of the invention will also appear in the description below.

In the appended drawings, provided as non-limiting examples:

Figure 1:
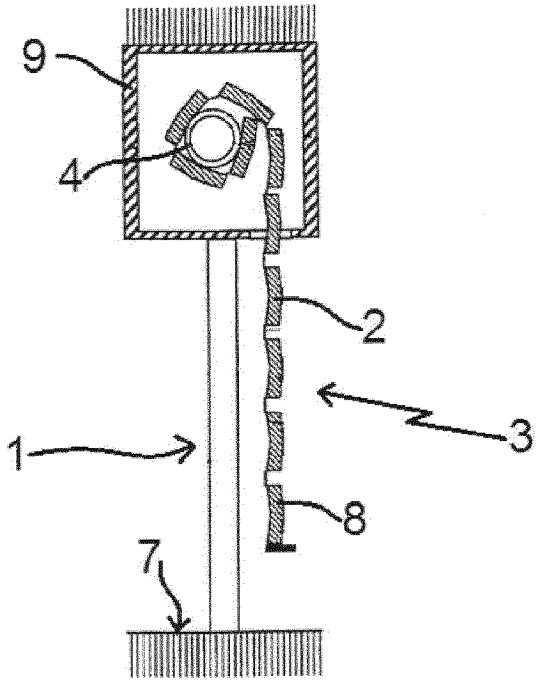
FIG. 1 is a cross-sectional schematic view of a home-automation facility according to one embodiment of the invention.
Figure 2:
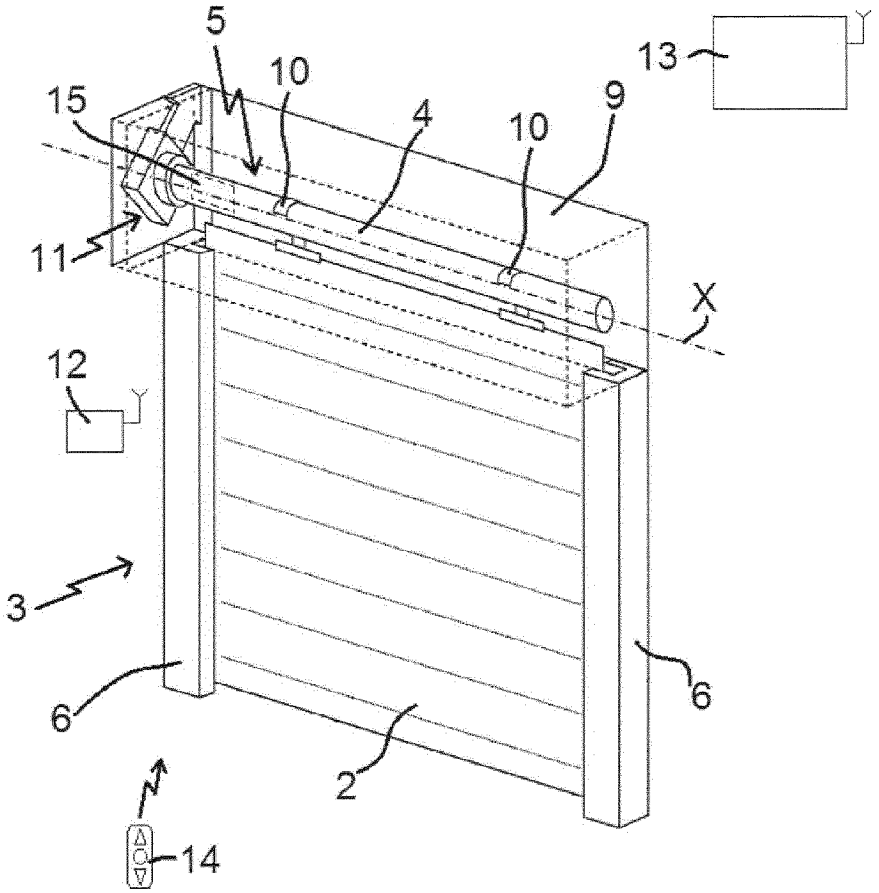
FIG. 2 is a schematic perspective view of the home-automation facility illustrated in FIG. 1.

In reference to FIGS. 1 and 2, we will first describe a home-automation facility according to the invention and installed in a building comprising an opening 1, window or door, equipped with a screen 2 belonging to a concealing device 3, in particular a motorized rolling shutter.

The concealing device 3 can be a rolling shutter, a canvas blind or a blind with orientable slats, or a rolling gate. Of course, the present invention applies to all types of concealing devices.

A rolling shutter according to one embodiment of the invention will be described in reference to FIGS. 1 and 2.

The screen 2 of the concealing device 3 is wound on a winding tube 4 driven by a motorized drive device 5 and movable between a wound position, in particular an upper position, and an unwound position, in particular a lower position.

The moving screen 2 of the concealing device 3 is a closing, concealing and/or solar protection screen, winding on the winding tube 4, the inner diameter of which is substantially equivalent to the outer diameter of an electromechanical actuator 11, such that the electromechanical actuator 11 can be inserted into the winding tube 4 during the assembly of the concealing device 3.

The motorized drive device 5 comprises the electromechanical actuator 11, in particular of the tubular type, making it possible to set the winding tube 4 in rotation so as to unwind or wind the screen 2 of the concealing device 3.

The concealing device 3 comprises the winding tube 4 for winding the screen 2, where, in the mounted state, the electromechanical actuator 11 is inserted into the winding tube 4.

In a known manner, the rolling shutter, which forms the concealing device 3, comprises an apron comprising horizontal slats articulated on one another, forming the screen 2 of the rolling shutter 3, and guided by two lateral guideways 6. These slats are joined when the apron 2 of the rolling shutter 3 reaches its unwound lower position.

In the case of a rolling shutter, the wound upper position corresponds to the bearing of a final L-shaped end slat 8 of the apron 2 of the rolling shutter 3 against an edge of a box 9 of the rolling shutter 3, and the unwound lower position corresponds to the bearing of the final end slat 8 of the apron 2 of the rolling shutter 3 against a threshold 7 of the opening 1.

The first slat of the rolling shutter 3, opposite the end slat, is connected to the winding tube 4 using at least one articulation 10.

The winding tube 4 is positioned inside the box 9 of the rolling shutter 3. The apron 2 of the rolling shutter 3 winds and unwinds around the rolling tube 4 and is housed at least partially inside the box 9.

In general, the box 9 is positioned above the opening 1, or in the upper part of the opening 1.

The motorized drive device 5 is controlled by a control unit. The control unit may for example be a local control unit 12, where the local control unit 12 can be connected through a wired or wireless connection with a central control unit 13. The central control unit 13 drives the local control unit 12, as well as other similar local control units distributed throughout the building.

The central control unit 13 can be in communication with a weather station located outside the building, in particular including one or more sensors that can be configured for example to determine the temperature, brightness, or wind speed.

A remote control 14, which can be a type of local control unit, and provided with a control keypad, which comprises selection and display means, further allows a user to intervene on the electromechanical actuator 11 and/or the central control unit 13.

The motorized drive device 5 is preferably configured to carry out the unwinding or winding command orders of the screen 2 of the concealing device 3, which may in particular be acquired by the remote control 14.

The electromechanical actuator 11 comprises an electric motor 16. The electric motor 16 comprises a rotor and a stator, not shown and positioned coaxially around a rotation axis X, which is also the rotation axis of the winding tube 4 in the assembled configuration of the motorized drive device 5.

Control means for controlling the electromechanical actuator 11 according to the invention, making it possible to move the screen 2 of the concealing device 3, are made up of at least one electronic control unit 15. This electronic control unit 15 is able to operate the electric motor 16 of the electromechanical actuator 11, and in particular to allow the supply of electricity for the electric motor 16.

Thus, the electronic control unit 15 in particular controls the electric motor 16, so as to open or close the screen 2, as previously described.

Figure 4:
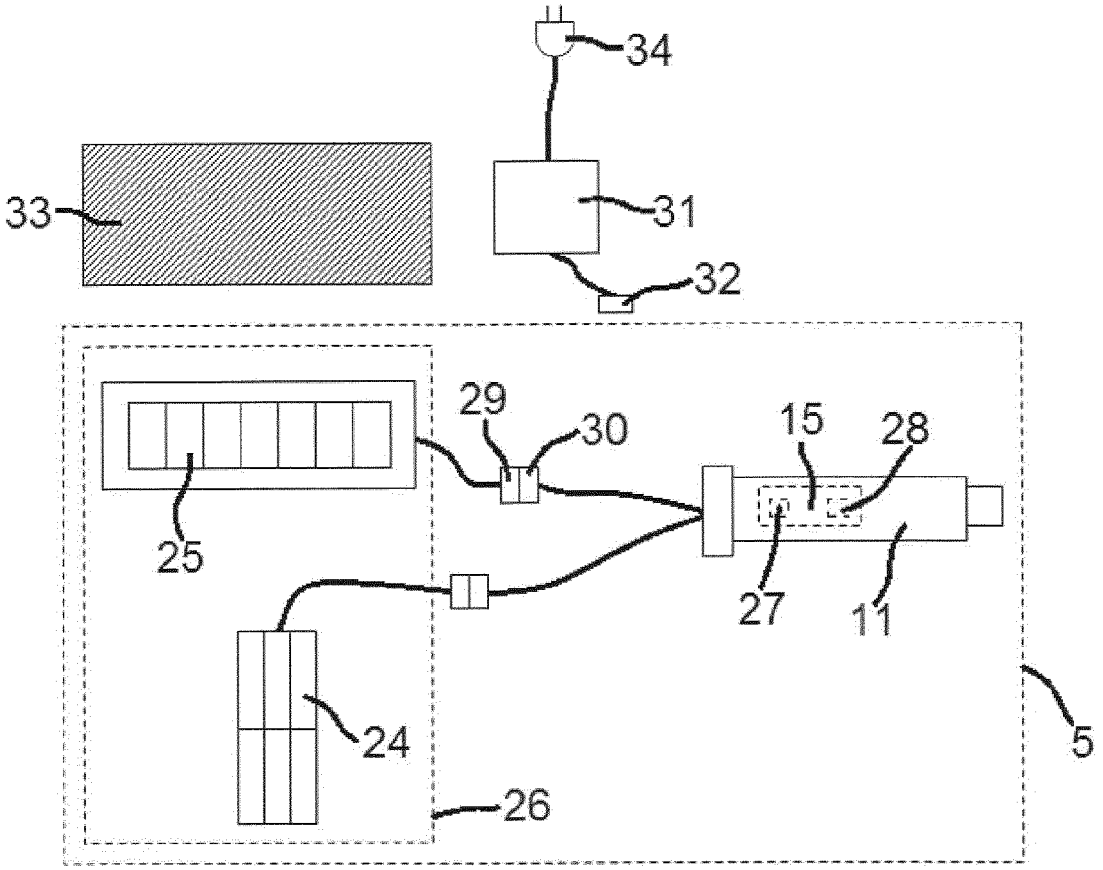
FIG. 4 is a schematic view of a motorized drive device for a home-automation facility as illustrated in FIGS. 1 to 3.

The electronic control unit 15 also comprises a command order receiving module 27, as illustrated in FIG. 4, the command orders being sent by an order transmitter such as the remote control 14 designed to control the electromechanical actuator 11.

Preferably, the command order receiving module 27 of the electronic control unit 15 is of the wireless type. In particular, the command order receiving module 27 is configured to receive wireless command orders.

The command order receiving module 27 can also allow the reception of command orders sent by wired means.

The control means of the electromechanical actuator 11 comprise hardware and/or software means.

As one non-limiting example, the hardware means may comprise at least one microcontroller.

The electromechanical actuator 11 belonging to the home-automation facility of FIGS. 1 and 2 will now be described in reference to FIGS. 3 and 4.

The electromechanical actuator 11 is supplied with electricity using at least one battery 24, able to be recharged by at least one photovoltaic cell 25, as illustrated in FIG. 4.

The electromechanical actuator 11 makes it possible to move the screen 2 of the concealing device 3.

Here, the electromechanical actuator 11 comprises a power supply cable 18 making it possible to supply electricity from the battery or batteries 24.

A case 17 of the electromechanical actuator 11 is preferably cylindrical.

In one embodiment, the case 17 is made from a metal material. The material of the electromechanical actuator is in no way limiting and may be different, and in particular made from plastic.

The electromechanical actuator 11 also comprises a reducing gear device 19 and an output shaft 20.

The electromechanical actuator 11 may also comprise an end-of-travel and/or obstacle detection device, which may be mechanical or electronic.

Advantageously, the electric motor 16 and the reducing gear device 19 are positioned inside the case 17 of the electromechanical actuator 11.

The output shaft 20 of the electromechanical actuator 11 is positioned inside the winding tube 4, and at least partially outside the case 17 of the electromechanical actuator 11.

The output shaft 20 of the electromechanical actuator 11 is coupled by a connecting means 22 to the winding tube 4, in particular using a wheel-shaped connecting means.

The electromechanical actuator 11 also comprises a sealing element 21 for one end of the case 17.

Here, the case 17 of the electromechanical actuator 11 is fastened to a support 23, in particular a flange, of the box 9 of the concealing device 3 using the closing off element 21 forming a torque pin, in particular a closing off and torque-reacting head. In such a case where the closing off element 21 forms a torque pin, the closing off element 21 is also called a fixed point of the electromechanical actuator 11.

Figure 3:
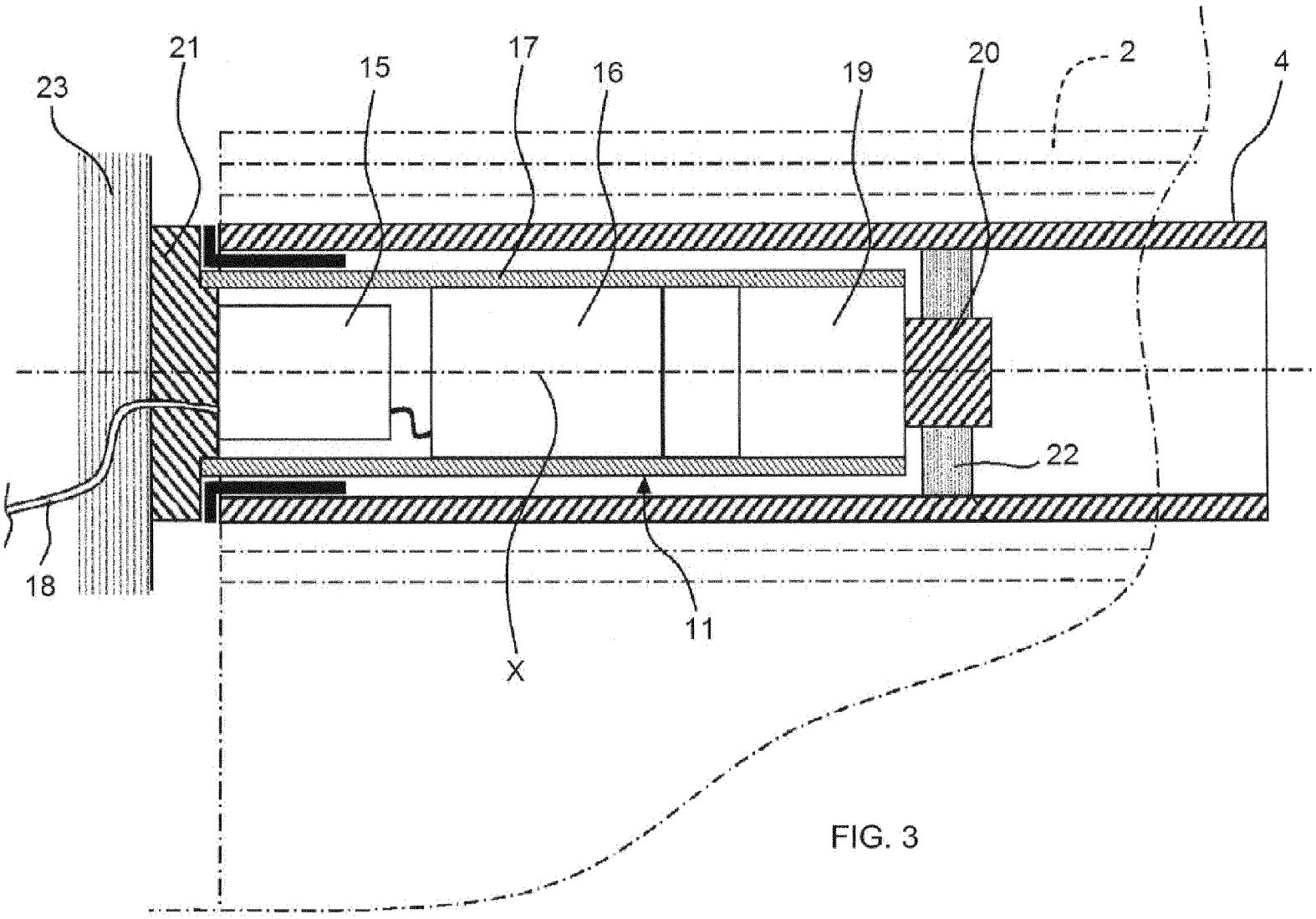
FIG. 3 is a schematic partial sectional view of the home-automation facility illustrated in FIG. 2 comprising an electromechanical actuator according to one embodiment of the invention.

Here, and as illustrated in FIG. 3, the electronic control unit 15 is positioned, or in other words integrated, inside a casing 17 of the electromechanical actuator 11.

In another embodiment, the electronic control unit 15 is positioned outside the casing 17 of the electromechanical actuator 11, and in particular, mounted on the support 23 or in the closing off element 21.

We will now describe, in reference to FIG. 4, a motorized drive device for a closure or solar protection home-automation facility according to one embodiment.

The motorized drive device 5 comprises an autonomous power supply device 26. The electromechanical actuator 11 is electrically connected to the autonomous power supply device 26.

The autonomous power supply device 26 comprises the battery or batteries 24 and the photovoltaic cell or photovoltaic cells 25.

Here, each battery 24 is positioned inside the box 9 of the concealing device 3.

In the following description, the expression "the battery 24" is used to designate one or more batteries depending on the configuration of the autonomous power supply device 26. Likewise, the expression "the photovoltaic cell 25" is used to designate one or more photovoltaic cells depending on the configuration of the autonomous power supply device 26.

Here and as illustrated in FIG. 4, the photovoltaic cell 25 is directly electrically connected to the electronic control unit 15. Additionally, the battery 24 is directly electrically connected to the electronic control unit 15.

Alternatively, not shown, the photovoltaic cell 25 is electrically connected to the battery 24. Additionally, the battery 24 is electrically connected to the electronic control unit 15.

Here, the battery 24 is of the rechargeable type and supplies electricity to the electromechanical actuator 11. Additionally, the battery 24 is supplied with electricity by the photovoltaic cell 25.

Thus, the recharging of the battery 24 is done by solar energy, using the photovoltaic cell 25.

In this way, the battery 24 can be recharged without having to disassemble part of the box 9 of the concealing device 3.

Advantageously, the motorized drive device 5, and in particular the photovoltaic cell 25, comprises charging elements configured to charge the battery 24 from the solar energy recovered by the photovoltaic cell 25.

Thus, the charging elements configured to charge the battery 24 from the solar energy make it possible to convert the solar energy recovered by the photovoltaic cell 25 into electricity.

In one embodiment, the autonomous power supply device 26 comprises a plurality of photovoltaic cells 25 making up a photovoltaic panel.

In one embodiment, the electricity supply of the electromechanical actuator 11 by the battery 24 can replace a power supply of the electromechanical actuator 11 with an electricity supply grid.

Thus, the electricity supply of the electromechanical actuator 11 by the battery 24 makes it possible to do away with a connection to the electricity supply grid.

In another embodiment, the electricity supply of the electromechanical actuator 11 is done on the one hand by an electricity supply grid, and on the other hand by the battery 24.

Thus, the electricity supply of the electromechanical actuator 11 by the battery 24 in particular makes it possible to make up for a cutoff of the electricity supply of the electromechanical actuator 11 with an electricity supply grid.

In this case, the electromechanical actuator 11 is supplied with electricity, on the one hand by a power supply cable connected to the electricity supply grid, and on the other hand by the battery 24.

Furthermore, the electricity supply of the electromechanical actuator 11 by an electricity supply grid makes it possible to recharge the battery 24, in particular when the battery 24 is not sufficiently recharged by the photovoltaic cell 25.

The electronic control unit 15 is configured to detect supply and cutoff periods of the electricity supply of the electromechanical actuator 11 from the photovoltaic cell 25, only via elements 28 measuring a quantity related to the electricity supply of the electromechanical actuator 11 by this photovoltaic cell 25.

An electricity supply period of the electromechanical actuator 11 from the photovoltaic cell 25 corresponds to the presence of the electrical connection connecting the photovoltaic cell 25 to the electromechanical actuator 11.

An electricity cutoff period of the electromechanical actuator 11 from the photovoltaic cell 25 corresponds to the absence of the electrical connection connecting the photovoltaic cell 25 to the electromechanical actuator 11. The absence of electrical connection connecting the photovoltaic cell 25 to the electromechanical actuator 11 may be due to the removal of the photovoltaic cell 25 relative to the autonomous power supply device 26, the cutoff of the electrical connection between the photovoltaic cell 25 and the electromechanical actuator 11, or the loss of electrical connection between the photovoltaic cell 25 and the electromechanical actuator 11.

Thus, the elements 28 for measuring a quantity related to the electricity supply of the electromechanical actuator 11 by the photovoltaic cell 25 make it possible to detect power supply and cutoff periods of the electricity supply of the electromechanical actuator 11 from the photovoltaic cell 25, so as to use the photovoltaic cell 25, and in particular the electricity supply delivered by the latter to the electromechanical actuator 11, to wake up the electronic control unit 15 or to place the electronic control unit 15 in a standby mode.

In this way, when the elements 28 for measuring a quantity related to the electricity supply of the electromechanical actuator 11 by the photovoltaic cell 25 detect the cutoff of the electricity supply of the electromechanical actuator 11 from the photovoltaic cell 25, the inputs and outputs of the electronic control unit 15, in particular of a microcontroller, are examined at a predetermined frequency lower than that used when the measuring elements 28 detect the electricity supply of the electromechanical actuator 11 from the photovoltaic cell 25, or even not examined, so as to reduce the electricity consumption by the electronic control device 15 and avoid the discharge of the battery 24.

When the elements 28 for measuring a quantity related to the electricity supply of the electromechanical actuator 11 by the photovoltaic cell 25 detect the cutoff of the electricity supply of the electromechanical actuator 11 from the photovoltaic cell 25, the electronic control unit 15 enters a standby mode, so as to reduce the electricity consumption by the electronic control device 15 and avoid the discharge of the battery 24.

The detection of the electricity cutoff of the electromechanical actuator 11 from the photovoltaic cell 25 by the measuring elements 28 makes it possible to diagnose a defect related to the electricity supply of the electromechanical actuator 11 by the photovoltaic cell 25, and in particular, to signal this defect, through a visual and/or audio signal.

When the elements 28 for measuring a quantity related to the electricity supply of the electromechanical actuator 11 by the photovoltaic cell 25 detect the electricity supply of the electromechanical actuator 11 from the photovoltaic cell 25, the motorized drive device 5 is able to be controlled.

Here, the electricity supply and cutoff periods of the electromechanical actuator 11 are detected using a direct electrical connection between the measuring elements 28 and the photovoltaic cell 25, and in particular, without the quantity measured by the measuring elements 28 traversing other elements making up the autonomous electricity supply device 26, for example the battery 24.

The detection of an electricity supply or cutoff of the electromechanical actuator 11 from the photovoltaic cell 25 is implemented by the measurement, through measuring elements 28, of a quantity related to the supply of electricity delivered by the photovoltaic cell 25.

The quantity related to the electricity supply delivered by the photovoltaic cell 25 may in particular be a voltage, a current or an impedance.

The value of the quantity related to the electricity supply of the electromechanical actuator 11 by the photovoltaic cell 25 is proportional to the light power captured by the photovoltaic cell 25, in other words, the value of this quantity supplying electricity to the electromechanical actuator 11 depends on the light intensity of the solar energy captured by the photovoltaic cell 25.

Here, the measuring elements 28 are an integral part of the electronic control unit 15.

As non-limiting examples, the measuring elements 28 may comprise either a voltage divider, a comparator and a microcontroller, one of the inputs of which is provided with an analog-digital converter, if the measured quantity is a voltage, or a shunt resistance and a microcontroller, one of the inputs of which is provided with an analog-digital converter, if the measured quantity is a current.

The electronic control unit 15 is also configured to reset at least part of the data stored by the electronic control unit 15, after the simulation of a sequence of supply and cutoff periods of the electricity supply of the electromechanical actuator 11, where the supply and cutoff periods of the electricity supply are detected through measuring elements 28.

Thus, the electronic control unit 15 can be reset, at least partially, by executing a series of electricity supply and cutoff periods of the electromechanical actuator 11, where the electricity supply and cutoff periods of the electrochemical actuator 11 are determined through measuring elements 28 measuring a quantity related to the electricity supply of the electromechanical actuator 11 by the photovoltaic cell 25.

In this way, at least part of the data stored by the electronic control unit 15 is reset, following the detection by the measuring elements 28 of the sequence of periods respectively corresponding to the presence or absence of the electrical connection connecting the photovoltaic cell 25 to the electromechanical actuator 11.

The data stored by the electronic control unit 15 being able to be reset can be the end-of-travel positions of the screen 2, the obstacle detection threshold(s), the control point(s) 12, 13, 14 paired with the electromechanical actuator 11.

In a first embodiment, the sequence of supply and cutoff periods of the electricity supply of the electromechanical actuator 11 is simulated by the connection and disconnection of a first electrical connector 29 connected to the photovoltaic cell 25 cooperating with a second electric connector 30 connected to the electronic control unit 15.

Thus, an electricity supply period of the electromechanical actuator 11 by the photovoltaic cell 25 is carried out by the electrical connection of the first electrical connector 29 connected to the said at least one photovoltaic cell 25 with the second electrical connector 30 connected to the electronic control unit 15. Additionally, an electricity cutoff period of the electromechanical actuator 11 from the photovoltaic cell 25 is carried out by the electrical disconnection of the first electrical connector 29 connected to the said at least one photovoltaic cell 25 with respect to the second electrical connector 30 connected to the electronic control unit 15.

In this way, the measuring elements 28 measure a quantity related to the electricity supply delivered by the photovoltaic cell 25. When the first electrical connector 29 connected to the said at least one photovoltaic cell 25 is connected on the second electrical connector 30 connected to the electronic control unit 15, the value of the measured quantity is above a threshold value, which means that the photovoltaic cell 25 is capturing rays of light. When the first electrical connector 29 connected to the said at least one photovoltaic cell 25 is disconnected from the second electrical connector 30 connected to the electronic control unit 15, the value of the measured quantity is zero and therefore below a threshold value, which means that the photovoltaic cell 25 is not capturing rays of light.

Here and as illustrated in FIG. 4, the first electrical connector 29 is connected to the photovoltaic cell 25 using a power supply cable. Additionally, the second electrical connector 30 is connected to the electronic control unit 15 using a power supply cable.

In such an embodiment, the first and second electrical connectors 29, 30 respectively connected to the said at least one photovoltaic cell 25 and to the electronic control unit 15 are accessible, in particular, by disassembling part of the box 9 of the concealing device 3.

In a second embodiment, the sequence of electricity supply and cutoff periods of the electromechanical actuator 11 is simulated using an outside electricity supply source 31. The outside electricity supply source 31 is electrically connected to the electromechanical actuator 11, replacing the photovoltaic cell 25.

Thus, an electricity supply period of the electromechanical actuator 11 by the outside electricity supply source 31 is carried out either by the electrical connection of the second electrical connector 30 connected to the electronic control unit 15 with a third electrical connector 32 connected to the outside electricity supply source 31, or by the closure of a switch of the outside electricity supply source 31. Additionally, an electricity cutoff period of the electromechanical actuator 11 from the outside electricity supply source 31 is carried out either by the electrical disconnection of the second electrical connector 30 connected to the electronic control unit 15 with respect to the third electrical connector 32 connected to the outside electricity supply source 31, or by the opening of the switch of the outside electricity supply source 31.

In this way, the measuring elements 28 measure a quantity related to the electricity supply delivered by the outside electricity supply source 31. When the second electrical connector 30 connected to the electronic control unit 15 is connected on the third electrical connector 32 connected to the outside electricity supply source 31, or when the switch of the outside electricity supply source 31 is closed, the value of the measured quantity is above a threshold value. When the second electrical connector 30 connected to the electronic control unit 15 is disconnected from the third electrical connector 32 connected to the outside electricity supply source 31, or when the switch of the outside electricity supply source 31 is open, the value of the measured quantity is zero and therefore below a threshold value.

Here and as illustrated in FIG. 4, the first electrical connector 29 is connected to the said at least one photovoltaic cell 25 using a power supply cable. The second electrical connector 30 is connected to the electronic control unit 15 using a power supply cable. Additionally, the third electrical connector 32 is connected to the outside electricity supply source 31 using a power supply cable.

Advantageously, the simulation of the sequence of electricity supply and cutoff periods of the electromechanical actuator 11 using the outside electricity supply source 31 is carried out when the photovoltaic cell 25 is faulty or when the photovoltaic cell 25 is not installed in the motorized drive device 5, in particular during an after-sales service operation or during the assembly of the motorized drive device 5.

In such an embodiment, the first, second and third electrical connectors 29, 30, 32 respectively connected to the said at least one photovoltaic cell 25, to the electronic control unit 15 and the outside electricity supply source 31 are accessible, in particular, by disassembling part of the box 9 of the concealing device 3.

Here, the outside electricity supply source 31 can be a transformer electrically connected to an electric grid, so as to convert an alternating voltage into a direct voltage.

The alternating voltage of the electric grid or sector voltage has, for example, a value of 230 VRMS (peak value of 325 V) for the French electric grid. Of course, the sector voltage may have different values, depending on the electric grid of the country in which the home-automation facility is installed.

The direct supply voltage of the electromechanical actuator 11, obtained at the output of the transformer, may for example be 12 V.

Alternatively, an electricity supply period of the electromechanical actuator 11 by the outside electricity supply source 31 is carried out by the electrical connection of an electric jack 34 connected to the outside electricity supply source 34 with an electric jack, not shown, connected to the electric grid, as well as the electrical connection of the second electrical connector 30 connected to the electronic control unit 15 with the third electrical connector 32 connected to the outside electricity supply source 31. Additionally, an electricity cutoff period of the electromechanical actuator 11 from the outside electricity supply source 31 is carried out by the electrical disconnection of the electric jack 34 connected to the outside electricity supply source 31 relative to the electric jack connected to the electric grid.

Here and as illustrated in FIG. 4, the electric jack 34 is connected to the outside electricity supply source 31 using a power supply cable.

In a third embodiment, the sequence of power supply and cutoff periods of the electricity supply of the electromechanical actuator 11 is simulated by removing a cover element 33 from the photovoltaic cell 25 and positioning the cover element 33 on the photovoltaic cell 25.

Thus, an electricity supply period of the electromechanical actuator 11 by the photovoltaic cell 25 is carried out by the removal of the cover element 33 placed on the photovoltaic cell 25. Additionally, an electricity cutoff period of the electromechanical actuator 11 from the photovoltaic cell 25 is carried out by the positioning of the cover element 33 on the photovoltaic cell 25.

In this way, the measuring elements 28 measure a quantity related to the electricity supply delivered by the photovoltaic cell 25. When the cover element 33 is removed with respect to the photovoltaic cell 25, the value of the measured quantity is above a threshold value, which means that the photovoltaic cell 25 is capturing rays of light. When the cover element 33 is placed on the photovoltaic cell 25, the value of the measured quantity is below a threshold value, which means that the photovoltaic cell 25 is capturing no or insufficient rays of light. In such an embodiment, the first and second electrical connectors 29, 30 respectively connected to the said at least one photovoltaic cell 25 and to the electronic control unit 15 may not be accessible.

By way of non-limiting example, the first, second and third electrical connectors 29, 30, 32 respectively connected to the said at least one photovoltaic cell 25, to the electronic control unit 15 and to the outside electricity supply source 31 are arranged at the support 23, and in particular, inside the box 9 of the concealing device 3, following the assembly of the motorized drive device 5 in the concealing device 3.

Advantageously, the electronic control unit 15 comprises the module 27 for receiving command orders wirelessly.

In practice, the wireless command order receiving module 27 is inhibited, following the detection by the electronic control unit 15 of the electricity cutoff of the electromechanical actuator 11 from the photovoltaic cell 25.

Thus, once the elements 28 for measuring a quantity related to the electricity supply of the electromechanical actuator 11 by the photovoltaic cell 25 detect the cutoff of the electricity supply of the electromechanical actuator 11 from the photovoltaic cell 25, the electronic control unit 15 enters a standby mode, called deep, so as to inhibit the wireless command order receiving module 27.

In this way, the transition to a standby mode, called deep, following the detection of the cutoff of the electricity supply of the electromechanical actuator 11 from the photovoltaic cell 25 by the measuring elements 28 makes it possible to reduce the electricity consumption by the electronic control device 15 and avoid the discharge of the battery 24.

Advantageously, the wireless command order receiving module 27 is woken up at a predetermined frequency, so as to detect command orders sent, in particular by a command order transmitter that may for example be the remote control 14, to the electronic control unit 15.

The waking of the wireless command order receiving module 27 at a predetermined frequency is carried out, preferably, in a standby mode, called active, from the electronic control unit 15, so as to temporarily inhibit the wireless command order receiving module 27.

The standby mode, so-called active, of the electronic control unit 15 is carried out, preferably, when the elements 28 for measuring a quantity related to the electricity supply of the electromechanical actuator 11 by the photovoltaic cell 25 detect the supply of electricity of the electromechanical actuator 11 from the photovoltaic cell 25, and when the wireless command order receiving module 27 has not received any command order, after a predetermined length of time has elapsed.

In one embodiment, the predetermined frequency for waking up the wireless command order receiving module 27 depends on the illumination power determined by measuring elements 28 measuring a quantity related to the electricity supply of the electromechanical actuator 11 by the photovoltaic cell 25.

Thus, the adaptation of the predetermined frequency for waking up the wireless command order receiving module 27 as a function of the illumination power determined by measuring elements 28 makes it possible to reduce the electricity consumption by the electronic control unit 15 and to limit the discharge of the battery 24.

In this way, the wake-up frequency of the wireless command order receiving module 27 is extended at night and reduced during the day, so as to reduce the electricity consumption by the electronic control unit 15 at night and guarantee reactive operation of the motorized drive device 5 during the day.

Advantageously, the predetermined frequency for waking up the wireless command order receiving module 27 can assume a plurality of values defined as a function of illumination power threshold values.

In one example embodiment, the wake-up frequency of the wireless command order receiving module 27 may be about 150 milliseconds when the illumination power determined via the measuring elements 28 is less than 10 $W/m^2$, 70 milliseconds when the illumination power determined via the measuring elements 28 is comprised between 10 $W/m^2$ and 200 $W/m^2$, and 20 milliseconds when the illumination power determined via the measuring elements 28 is greater than 200 $W/m^2$.

In another embodiment, the predetermined frequency for waking up the wireless command order receiving module 27 depends on the charge level of the battery 24.

Thus, the adaptation of the predetermined frequency for waking up the wireless command order receiving module 27 as a function of the charge level of the battery 24 makes it possible to reduce the electricity consumption by the electronic control unit 15 and to avoid the discharge of the battery 24.

In this way, the reaction time of the motorized drive device 5 after the transmission of the command order, in particular from the remote control 14, allows the user to deduce the charge level of the battery 24 therefrom, since the predetermined wake-up frequency of the wireless command order receiving module 27 is longer or shorter, as a function of the charge level of the battery 24.

In another embodiment, the predetermined frequency for waking up the wireless command order receiving module 27 depends, on the one hand, on the illumination power determined by measuring elements 28 measuring a quantity related to the electricity supply of the electromechanical actuator 11 by the photovoltaic cell 25 and, on the other hand, on the charge level of the battery 24.

In one example embodiment, the wake-up frequency of the wireless command order receiving module 27 may be about 150 milliseconds when the illumination power determined via the measuring elements 28 is less than 10 $W/m^2$ and the charge level of the battery 24 is greater than or equal to 50%, 300 milliseconds when the illumination power determined via the measuring elements 28 is less than 10 $W/m^2$ and the charge level of the battery 24 is less than 50%.

We will now describe a method for controlling the operation of the motorized drive device 5 according to one embodiment of the invention.

The control method comprises a step for detecting supply and cutoff periods of the electricity supply of the electromechanical actuator 11 from the photovoltaic cell 25.

This detection step is carried out only using elements 28 for measuring a quantity related to the power supply of the electromechanical actuator 11 by the said at least one photovoltaic cell 25.

Following the detection of a period for supplying electricity for the electromechanical actuator 11 from the photovoltaic cell 25, the electronic control unit 15 enters a standby mode, so-called active, during which the inputs and outputs of the electronic control unit 15, in particular a microcontroller, are examined at a predetermined frequency. Additionally, in particular, the wireless command order receiving module 27 is woken up at a predetermined frequency, so as to receive a command order sent by a command order transmitter, which may for example be the remote control 14.

Additionally, following the detection of a period for cutting off electricity for the electromechanical actuator 11 from the photovoltaic cell 25, the electronic control unit 15 enters a standby mode, so-called deep, during which the inputs and outputs of the electronic control unit 15, in particular a microcontroller, are examined at a predetermined frequency that is less than that of the standby mode, so-called active, carried out following the detection of a period for supplying electricity for the electromechanical actuator 11 from the photovoltaic cell 25. In particular, the wireless command order receiving module 27 is inhibited, so as to reduce the electricity consumption by the electronic control unit 15 and to avoid the discharge of the battery 24.

Preferably, the predetermined frequency for the examination of the inputs and outputs of the electronic control unit 15, in particular a microcontroller, and, in particular, standby of the wireless command order receiving module 27 is reduced, when the measuring elements 28 measure a zero value or a value below a threshold value of the quantity related to the electricity supply of the electromechanical actuator 11 by the photovoltaic cell 25.

The control method also comprises a step for simulating a sequence of supply and cutoff periods of the electricity supply of the electromechanical actuator 11, where the supply and cutoff periods of the electricity supply are detected through measuring elements 28.

This simulation step can be carried out by the electrical connection and disconnection of the first electrical connector 29 connected to the said at least one photovoltaic cell 25 cooperating with the second electrical connector 30 connected to the electronic control unit 15, using the outside electricity supply source 31 electrically connected to the electromechanical actuator 11 by replacing the photovoltaic cell 25, or by the positioning or removal of the cover element 33 on the photovoltaic cell 25.

The control method comprises a step for resetting at least part of the data stored by the electronic control unit 15, after the simulation step is carried out.

In one example embodiment, the sequence of supply and cutoff periods of the electricity supply of the electromechanical actuator 11 comprises a first cutoff period of the electricity supply during a predetermined time period, which may be approximately two seconds, an electricity supply period for a predetermined time period, which may be approximately seven seconds, and a second electricity cutoff period for a predetermined time period, which may be approximately two seconds.

After the simulation step is carried out, at least part of the data stored by the electronic control unit 15 can be reset, in particular once the predetermined time period of the second cutoff period of the electricity supply has elapsed.

Owing to the present invention, the elements for measuring a quantity related to the electricity supply of the electromechanical actuator by the photovoltaic cell make it possible to detect power supply and cutoff periods of the electricity supply of the electromechanical actuator from the photovoltaic cell, so as to use the photovoltaic cell, and in particular the electricity supply delivered by the latter to the electromechanical actuator, to wake up the electronic control unit or to place the electronic control unit in a standby mode.

The present invention also makes it possible to reset, at least partially, the data stored by the electronic control unit, by executing a series of electricity supply and cutoff periods of the electromechanical actuator, where the electricity supply and cutoff periods of the electrochemical actuator are determined through measuring elements measuring a quantity related to the electricity supply of the electromechanical actuator by the photovoltaic cell.

Many changes can be made to the example embodiments previously described without going beyond the scope of the invention defined by the claims.

In particular, the battery may be a single battery or a group of batteries connected using an electrical insulator.

Furthermore, the considered embodiments and alternatives may be combined to generate new embodiments of the invention, without going beyond the scope of the invention defined by the claims.

The invention claimed is:

1. A motorized drive device for a closure or solar protection home-automation facility, comprising:

an electromechanical actuator, an electronic control unit, an autonomous power supply device, the autonomous power supply device comprising at least one battery and at least one photovoltaic cell, where the electromechanical actuator is electrically connected to the autonomous power supply device, wherein the electronic control unit is configured to:

detect power supply and cutoff periods of the electricity supply of the electromechanical actuator from the said at least one photovoltaic cell, only using elements for measuring a quantity related to the electricity supply of the electromechanical actuator by the said at least one photovoltaic cell, and resetting at least part of the data stored by the electronic control unit, after the simulation of a sequence of power supply and cutoff periods of the electricity supply of the electromechanical actuator, where the power supply and cutoff periods of the electricity supply are detected through measuring elements.

2. The motorized drive device according to claim 1, wherein the electronic control unit comprises at least one wireless command order receiving module.

3. A closure or solar protection home-automation facility comprising a screen that is windable using a motorized drive device on a winding tube rotated by a electromechanical actuator, wherein the motorized drive device is according claim 1.

4. An operating method for controlling a motorized drive device for a closure or solar protection home-automation facility, the motorized drive device comprising:

an electromechanical actuator, an electronic control unit, an autonomous power supply device, the autonomous power supply device comprising at least one battery and at least one photovoltaic cell, where the electromechanical actuator is electrically connected to the autonomous power supply device, wherein the method comprises at least the following steps:

detecting power supply and cutoff periods of the electricity supply of the electromechanical actuator from the said at least one photovoltaic cell, only using elements for measuring a quantity related to the electricity supply of the electromechanical actuator by the said at least one photovoltaic cell, simulating a sequence of supply and cutoff periods of the electricity supply of the electromechanical actuator, where the supply and cutoff periods of the electricity supply are detected through measuring elements, and resetting at least part of the data stored by the electronic control unit, after the simulation step is carried out.

5. The operating method for controlling a motorized drive device according to claim 4, wherein the sequence of supply and cutoff periods of the electricity supply of the electromechanical actuator is simulated by the connection and disconnection of a first electrical connector connected to the said at least one photovoltaic cell cooperating with a second electric connector connected to the electronic control unit.

6. The operating method for controlling a motorized drive device according to claim 4, wherein the sequence of electricity supply and cutoff periods of the electromechanical actuator is simulated using an outside electricity supply source, where the outside electricity supply source is electrically connected to the electromechanical actuator by replacing the said at least one photovoltaic cell.

7. The operating method for controlling a motorized drive device according to claim 4, wherein the sequence of power supply and cutoff periods of the electricity supply of the electromechanical actuator is simulated by removing a cover element from the said at least one photovoltaic cell and positioning the cover element on the said at least one photovoltaic cell.

8. The operating method for controlling a motorized drive device according to claim 4, wherein the electronic control unit of the motorized drive device comprises at least one wireless command order receiving module and wherein the wireless command order receiving module is inhibited, following the detection by the electronic control unit of the electricity cutoff of the electromechanical actuator from the said at least one photovoltaic cell.

9. The operating method for controlling a motorized drive device according to claim 4, wherein the electronic control unit of the motorized drive device comprises at least one wireless command order receiving module and wherein the wireless command order receiving module is woken up at a predetermined frequency, so as to detect command orders sent to the electronic control unit.

10. The operating method for controlling a motorized drive device according to claim 9, wherein the predetermined frequency for waking up the wireless command order receiving module depends on the illumination power determined by measuring elements measuring a quantity related to the electricity supply of the electromechanical actuator by the said at least one photovoltaic cell.

11. The operating method for controlling a motorized drive device according to claim 9, wherein the predetermined frequency for waking up the wireless command order receiving module depends on the charge level of the said at least one battery.

* * * * *